US012654896B2

(12) United States Patent
Basharanov et al.

(10) Patent No.: US 12,654,896 B2
(45) **Date of Patent: *Jun. 16, 2026**

(54) WRAPPING MACHINE WITH WRAPPING-ZONE INDICATOR

(71) Applicant: Signode Bulgaria EOOD, Kardjali (BG)

(72) Inventors: Pavel Basharanov, Kardzhali (BG); Roslan Danadzhiev, Kardzhali (BG)

(73) Assignee: Signode Bulgaria EOOD, Kardjali (BG)

( * ) Notice: Subject to any disclaimer, the term of this patent is extended or adjusted under 35 U.S.C. 154(b) by 0 days.

This patent is subject to a terminal disclaimer.

(21) Appl. No.: 19/073,763

(22) Filed: Mar. 7, 2025

(65) Prior Publication Data

US 2025/0206481 A1 Jun. 26, 2025

Related U.S. Application Data

(63) Continuation of application No. 18/355,652, filed on Jul. 20, 2023, now Pat. No. 12,246,873.

(60) Provisional application No. 63/369,433, filed on Jul. 26, 2022.

(51) Int. Cl.

| | |
|---|---|
| ***B65B 57/18*** | (2006.01) |
| ***B65B 11/02*** | (2006.01) |
| ***B65B 57/10*** | (2006.01) |

(52) U.S. Cl.

CPC ..... *B65B 57/18* (2013.01); *B65B 11/025* (2013.01); *B65B 57/10* (2013.01); *B65B 2210/20* (2013.01)

(58) Field of Classification Search

CPC ..... B65B 57/18; B65B 11/025; B65B 7/10; B65B 2210/20

See application file for complete search history.

(56) References Cited

U.S. PATENT DOCUMENTS

| | | | | |
|---|---|---|---|---|
| 4,050,220 | A * | 9/1977 | Lancaster | B65B 61/06 53/550 |
| 4,676,048 | A * | 6/1987 | Lancaster | B65B 11/008 53/399 |
| 4,680,464 | A * | 7/1987 | Bross | G06M 7/02 53/57 |
| 5,315,809 | A * | 5/1994 | Gordon | B65B 11/025 53/399 |
| 7,178,317 | B1 | 2/2007 | Koskela | |

(Continued)

FOREIGN PATENT DOCUMENTS

| | | |
|---|---|---|
| CN | 107848652 A | 3/2018 |
| EP | 2205491 B1 | 3/2015 |

(Continued)

OTHER PUBLICATIONS

"Extended European Search Report", from corresponding European Patent Application No. 23187857.0, Feb. 9, 2024.

*Primary Examiner* — Lucas E. A. Palmer

(74) *Attorney, Agent, or Firm* — Neal, Gerber & Eisenberg LLP

(57) ABSTRACT

Various embodiments of the present disclosure provide a wrapping machine that includes an indicating device including one or more light sources configured to project a visible wrapping-zone indicator. The wrapping-zone indicator includes a boundary at least partially surrounding a wrapping zone of the wrapping machine to indicate the wrapping zone.

17 Claims, 8 Drawing Sheets

(56) References Cited

U.S. PATENT DOCUMENTS

| | | | | |
|---|---|---|---|---|
| 8,641,027 | B2 | 2/2014 | Koskela et al. | |
| 11,242,165 | B2 | 2/2022 | Basharanov et al. | |
| 11,833,693 | B2 | 12/2023 | Schuthe et al. | |
| 12,246,873 | B2 * | 3/2025 | Basharanov | B65B 57/005 |
| 2014/0083058 | A1 * | 3/2014 | Issing | B65B 35/30 53/473 |
| 2017/0001315 | A1 * | 1/2017 | Katayama | B25J 19/06 |
| 2019/0002138 | A1 * | 1/2019 | Laghi | B65B 41/16 |
| 2019/0156697 | A1 * | 5/2019 | Trovato | G09B 19/003 |

FOREIGN PATENT DOCUMENTS

| | | | | |
|---|---|---|---|---|
| JP | 2021053801 | A * | 4/2021 | |
| WO | WO-2012153248 | A1 * | 11/2012 | B65B 11/025 |

* cited by examiner

WRAPPING MACHINE WITH WRAPPING-ZONE INDICATOR

PRIORITY

This application is a continuation of, claims priority to and the benefit of U.S. Non-Provisional patent application Ser. No. 18/355,652 filed Jul. 20, 2023 that claims priority to and the benefit of U.S. Provisional Patent Application No. 63/369,433, filed Jul. 26, 2022, the entire contents of each of which is incorporated herein by reference.

FIELD

The present disclosure relates to wrapping machines, and more particularly to wrapping machines that wrap wrapping material, such as plastic stretch film, around a load to unitize the load.

BACKGROUND

Several types of known wrapping machines wrap wrapping material, such as plastic stretch film, around a load of goods to unitize the load and, in certain scenarios, to secure the load to a pallet. These wrapping machines each include a wrapping-material carriage to which a replaceable roll of wrapping material is mounted. Depending on the type of wrapping machine, the wrapping-material carriage rotates relative to the load or the load rotates relative to the wrapping-material carriage while the wrapping-material carriage vertically moves relative to the load to wrap the load with the wrapping material in a spiral pattern.

For instance, a rotating-arm wrapping machine rotates a cantilevered arm carrying the wrapping-material carriage around the load along a circular path while vertically moving the wrapping-material carriage to wrap the load. To indicate where the wrapping material carriage will move during operation of the wrapping machine, the circular path is typically painted or taped on the floor of the facility in which the wrapping machine is located. But over time the paint can fade or chip away and the tape can peel or otherwise be destroyed. Also, certain rotating-arm wrapping machines are mobile and moved to several different locations in the facility to wrap loads. This requires application and upkeep of paint and/or tape at each location. It also limits the flexibility of the mobile wrapping machine, as it can only be used in locations in which the paths are painted or taped on the floor of the facility.

SUMMARY

Various embodiments of the present disclosure provide a wrapping machine that includes an indicating device including one or more light sources configured to project a visible wrapping-zone indicator. The wrapping-zone indicator includes a boundary at least partially surrounding a wrapping zone of the wrapping machine to indicate the wrapping zone.

DETAILED DESCRIPTION

Figure 1:
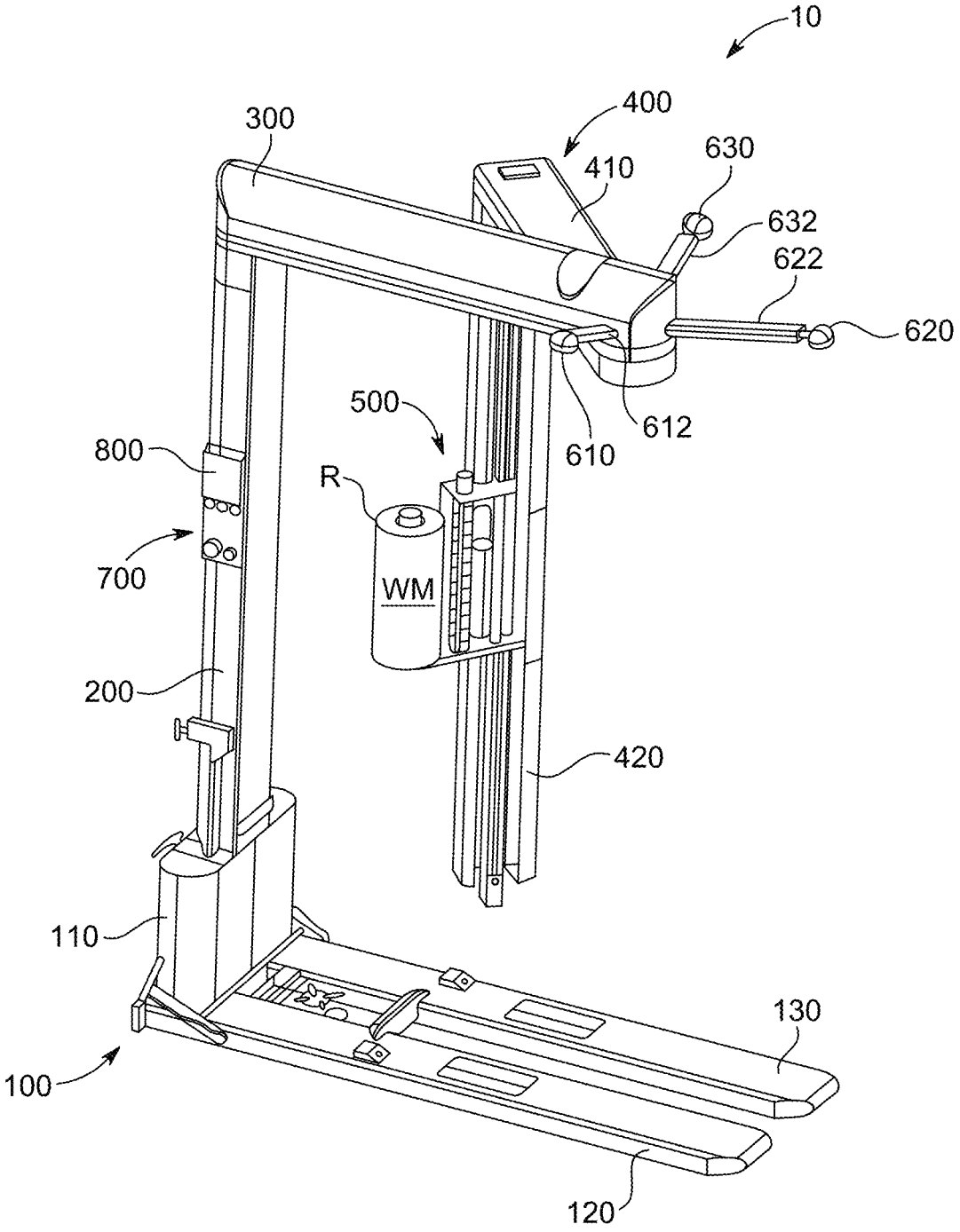
FIG. 1 is a perspective view of one example embodiment of a wrapping machine of the present disclosure.

While the systems, devices, and methods described herein may be embodied in various forms, the drawings show and the specification describes certain exemplary and non-limiting embodiments. Not all of the components shown in the drawings and described in the specification may be required, and certain implementations may include additional, different, or fewer components. Variations in the arrangement and type of the components; the shapes, sizes, and materials of the components; and the manners of connections of the components may be made without departing from the spirit or scope of the claims. Unless otherwise indicated, any directions referred to in the specification reflect the orientations of the components shown in the corresponding drawings and do not limit the scope of the present disclosure. Further, terms that refer to mounting methods, such as mounted, connected, etc., are not intended to be limited to direct mounting methods but should be interpreted broadly to include indirect and operably mounted, connected, and like mounting methods. This specification is intended to be taken as a whole and interpreted in accordance with the principles of the present disclosure and as understood by one of ordinary skill in the art.

Figure 2:
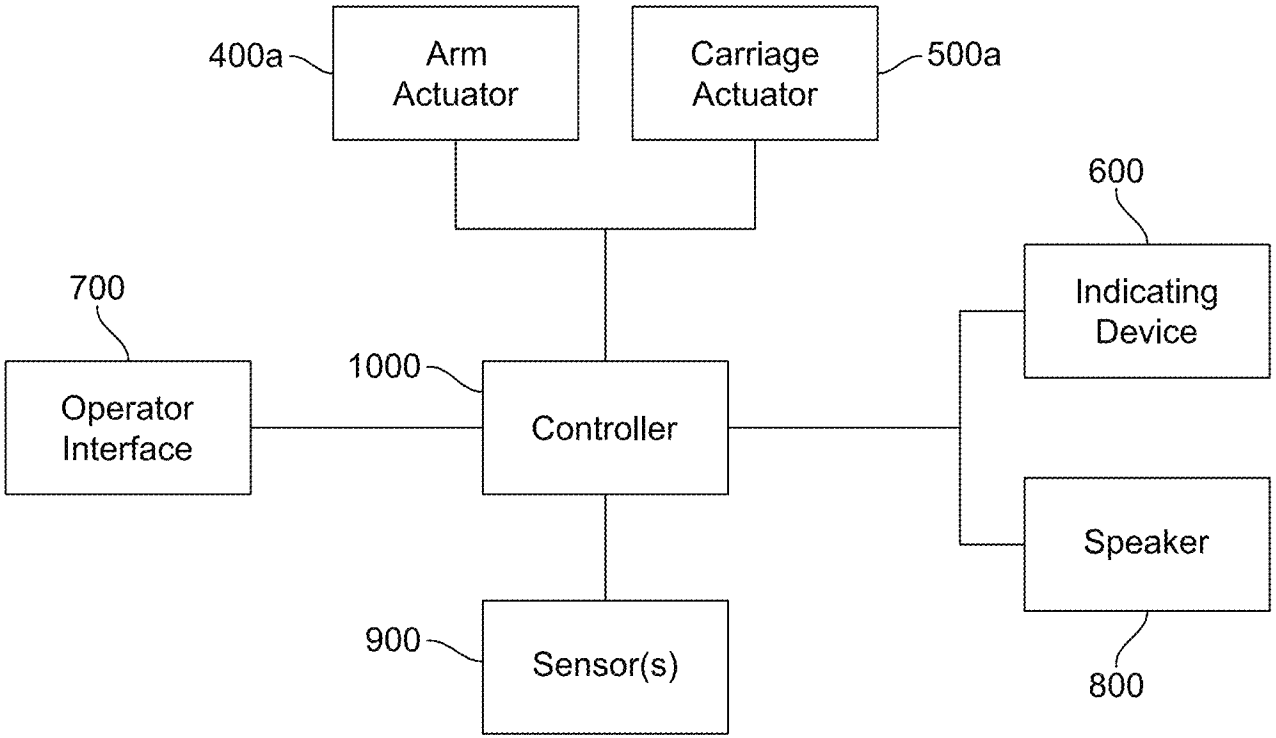
FIG. 2 is a block diagram showing certain components of the wrapping machine of FIG. 1.

Various embodiments of the present disclosure provide a wrapping machine that includes an indicating device including one or more light sources configured to project a visible wrapping-zone indicator. The wrapping-zone indicator includes a boundary at least partially surrounding a wrapping zone of the wrapping machine to indicate the wrapping zone. FIGS. 1 and 2 show one example embodiment of the wrapping machine 10 of the present disclosure and components thereof. The wrapping machine 10 includes a base 100, a mast 200, a rotatable-arm support 300, a rotatable arm 400, an arm actuator 400*a*, a wrapping-material carriage 500, a carriage actuator 500*a*, an indicating device 600, an operator interface 700, a speaker 800, one or more sensors 900, and a controller 1000.

The base 100 includes a base frame 110, first and second forks 120 and 130, multiple wheels (not shown), and a raising-and-lowering assembly (not shown). The base frame 110 includes a suitable framework configured to support some (or all) of the remaining components of the wrapping machine 10. The first and second forks 120 and 130 are parallel and spaced-apart from one another and extend from the base frame 110. The wheels are mounted to the base frame 110 and/or the first and second forks 120 and 130. The raising-and-lowering assembly is operably connected to the base frame 110 and the first and second forks 120 and 130 and configured to raise and lower base frame 110 and the first and second forks 120 and 130. When the base frame 110 and the first and second forks 120 and 130 are lowered, they rest on whatever support surface is supporting the wrapping machine 10. In this lowered position, the wheels are retracted into the base frame 110 and/or the first and second forks 120 and 130 such that the wrapping machine 10 is not readily movable. Conversely, when the base frame 110 and the first and second forks 120 and 130 are raised, they are supported by the wheels, which enable the wrapping machine 10 to be readily moved.

The mast 200 includes a suitable framework configured to support other components of the wrapping machine 10, as described below. The mast 200 is supported by and extends upward from the base 100 and, particularly, by the base frame 110. The rotatable-arm support 300 is connected at one end to the top of the mast 200 and extends transversely (here, perpendicularly) from the mast 200 in the same direction as the first and second forks 120 and 130 extend from the base frame 110 of the base 100. The base 100, the mast 200, and the rotatable-arm support 300 form a C-shape when viewed from the side.

The rotatable arm 400 is rotatably connected to the rotatable-arm support 300 near the free end of the rotatable-arm support 300 and configured to rotate relative to the base 100, the mast 200, and the rotatable-arm support 300 about a rotational axis $A_{400}$. The rotatable arm 400 includes a wrapping-arm support 410 and a wrapping arm 420 connected to and extending transversely (here, perpendicularly) from one end of the wrapping-arm support 410. The other end of the wrapping-arm support 410 is rotatably connected to the free end of the rotatable-arm support 300 such that the rotatable arm 400 has an inverted L-shape in which the wrapping-arm support 410 is generally parallel to the rotatable-arm support 300 and the wrapping arm 420 is generally perpendicular to the rotatable-arm support 300 and generally parallel to the mast 200.

The arm actuator 400*a* is operably connected to the rotatable arm 400 and configured to rotate the rotatable arm 400 relative to the base 100, the mast 200, and the rotatable-arm support 300 in a wrapping direction (see the arrow in FIG. 3) about the axis $A_{400}$. The arm actuator 400*a* includes an electric motor in this example embodiment but may include any other suitable actuator in other embodiments. In certain embodiments, the arm actuator 400*a* is operably connected to the rotatable arm 400 via a suitable transmission including gearing and other suitable components configured to transfer the output of the arm actuator 400*a* into rotation of the rotatable arm 400. In this example embodiment, the arm actuator 400*a* is positioned within the rotatable-arm support 300, though it may be positioned in any suitable location in other embodiments.

The wrapping-material carriage 500 is movably mounted to the wrapping arm 420 of the rotatable arm 400 such that the wrapping-material carriage 500 can move relative to the wrapping arm 420. The wrapping-material carriage 500 includes a frame (not labeled) that rotatably supports a roll R of wrapping material WM (such as plastic stretch film or any other suitable wrapping material). The wrapping-material carriage 500 includes multiple rollers (not labeled) supported by the frame and around which the wrapping material WM is directed as the wrapping material WM is drawn off the roll R during wrapping. In certain embodiments, the wrapping-material carriage 500 includes one or more pre-stretch actuators operably connected to one or more of the rollers to control the rotational speed of the roller(s) such that the wrapping material WM is pre-stretched as it is drawn and through the rollers. For instance, in certain embodiments the film-feed actuator is operably connected to two rollers and configured to rotate those rollers at different rotational speeds to cause the film to pre-stretch as it is drawn through the pre-stretch rollers.

The carriage actuator 500*a* is operably connected to the wrapping-material carriage 500 and configured to move the wrapping-material carriage 500 along the wrapping arm 420. In this example embodiment, this movement is vertical movement such that the carriage actuator 500*a* is configured to move the wrapping-material carriage 500 between a lower position near the free end of the wrapping arm 420 and an upper position near where the wrapping arm 420 meets the wrapping-arm support 410. The carriage actuator 500*a* includes an electric motor in this example embodiment but may include any other suitable actuator in other embodiments. In certain embodiments, the carriage actuator 500*a* is operably connected to the wrapping-material carriage 500 via a suitable transmission including gearing and other suitable components configured to transfer the output of the carriage actuator 500*a* into movement of the wrapping-material carriage 500. In this example embodiment, the carriage actuator 500*a* is positioned within the wrapping-arm support 410, though it may be positioned in any suitable location in other embodiments.

Figure 3:
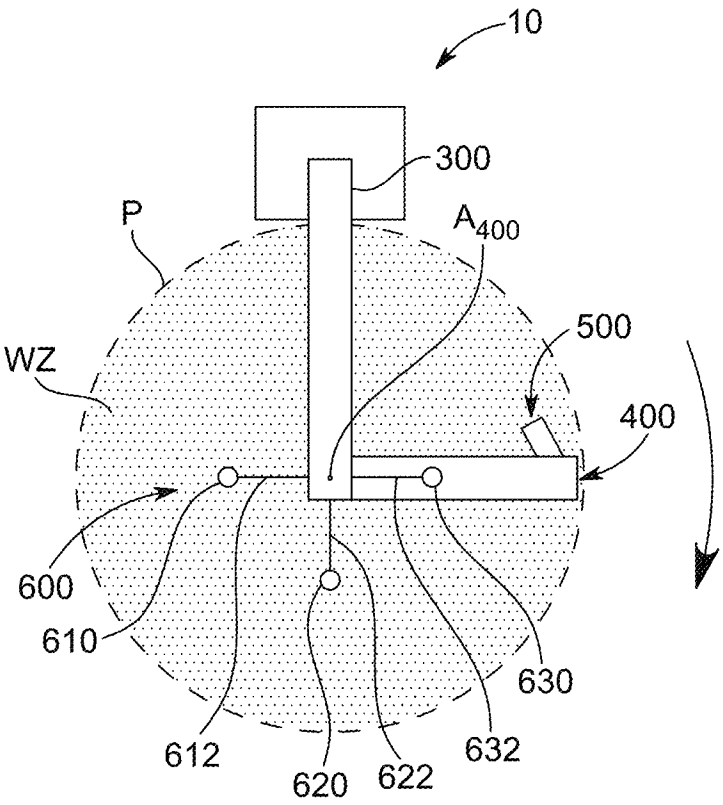
FIG. 3 is a diagrammatic top plan view of the wrapping machine of FIG. 1 that shows a wrapping zone of the wrapping machine.

As best shown in FIG. 3, the rotatable arm 400 is configured to rotate the wrapping-material carriage 500 along a path P as the rotatable arm 400 completes a complete rotation around the axis $A_{400}$. The path P is circular in this example embodiment. The path P defines a wrapping zone WZ of the wrapping machine 10, which includes the area within the path P.

Figure 4:
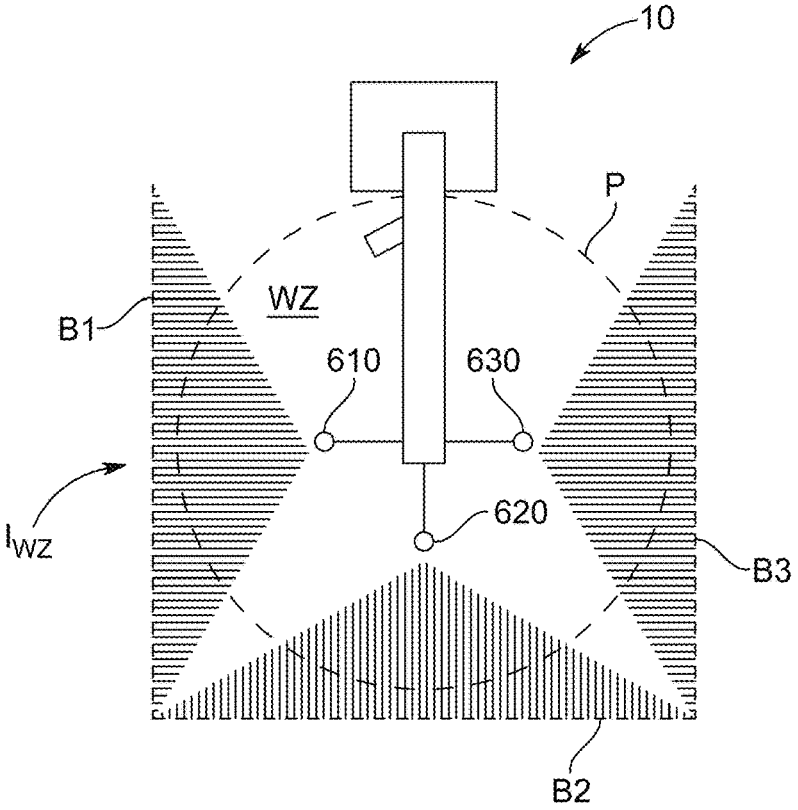
FIG. 4 is a diagrammatic top plan view of the wrapping machine of FIG. 1 that shows a wrapping-zone indicator that is projected by the indicating device of the wrapping machine.

As best shown in FIG. 4, the indicating device 600 is configured to project a visible wrapping-zone indicator including a boundary at least partially surrounding the wrapping zone of the wrapping machine to indicate the wrapping zone. More specifically, the indicating device 600 includes one or more light sources configured to project onto a support surface, such as the floor supporting the wrapping machine 10, a visible wrapping-zone indicator $I_{WZ}$ that includes a boundary at least partially surrounding the wrapping zone WZ of the wrapping machine 10. In this example embodiment, the indicating device 600 includes first, second, and third light sources 610, 620, and 630 connected to the rotatable-arm support 300 via support arms 612, 622, and 632, respectively. The first, second, and third light sources 610, 620, and 630 are configured to project visible bar-shaped beams of light B1, B2, and B3, respectively, onto the support surface (the beams may take any suitable shape in other embodiments). Together, those beams of light B1, B2, and B3 form the wrapping-zone indicator $I_{WZ}$ and partially surround the wrapping zone WZ. In this example embodiment, the wrapping-zone indicator $I_{WZ}$ borders but does not extend through the wrapping zone WZ. The first, second, and third light sources 610, 620, and 630 are positioned, oriented, and otherwise configured so the beams of light B1, B2, and B3 form three sides of a rectangle (and here, a square) that partially surround the wrapping zone WZ and form the wrapping-zone indicator $I_{WZ}$. The beams of light B1 and B3 are generally parallel to one another and are spaced apart by the beam of light B2, which extends between and is generally perpendicular to the beams of light B1 and B3. In this example embodiment, each light source includes a light-emitting diode, though any other suitable light source may be employed, such as a laser or an incandescent light bulb. The indicating device may include any suitable quantity of light sources, and the wrapping-zone indicator may take any suitable shape.

Figure 5:
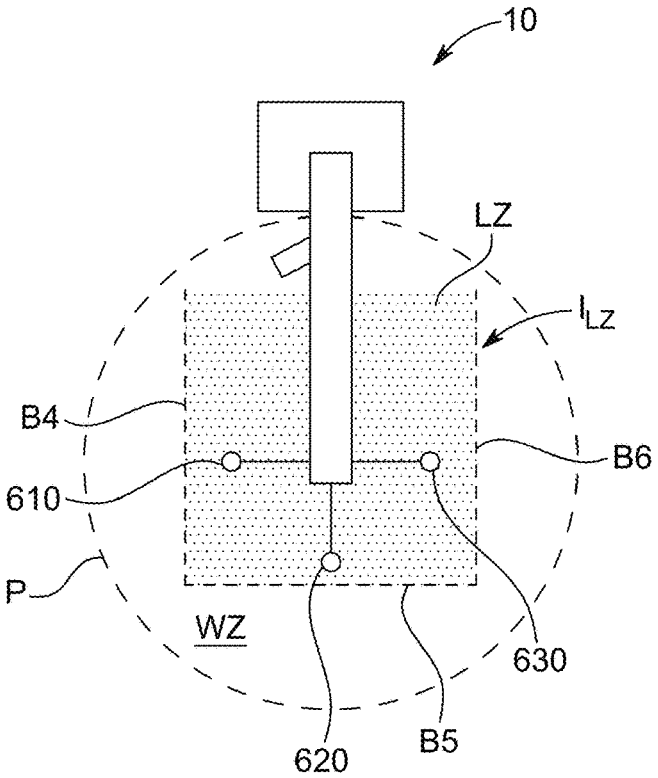
FIG. 5 is a diagrammatic top plan view of the wrapping machine of FIG. 1 that shows a loading zone of the wrapping machine and a loading-zone indicator that is projected by the indicating device of the wrapping machine.

In certain embodiments, and as best shown in FIG. 5, the indicating device 600 is also configured to indicate a loading zone LZ of the wrapping machine 10. The loading zone LZ of the wrapping machine 10 is the area in which a load is positioned to be wrapped by the wrapping machine 10. Specifically, the indicating device 600 includes one or more light sources configured to project onto the support surface a visible loading-zone indicator $I_{LZ}$ that includes a boundary at least partially surrounding the loading zone LZ of the wrapping machine 10. In this example embodiment, the first, second, and third light sources 610, 620, and 630 (though different light sources may be employed in other embodiments) are configured to project visible bar-shaped beams of light B4, B5, and B6, respectively, onto the support surface. Together, those beams of light B4, B5, and B6 form the loading-zone indicator $I_{LZ}$ and partially surrounds the loading zone LZ. The first, second, and third light sources 610, 620, and 630 are positioned, oriented, and otherwise configured so the beams of light B4, B5, and B6 form three sides of a rectangle that partially surround the loading zone LZ and form the loading-zone indicator $I_{LZ}$. The beams of light B4 and B6 are generally parallel to one another and are spaced apart by the beam of light B5, which extends between and is generally perpendicular to the beams of light B4 and B6.

The operator interface 700 is configured to receive inputs from an operator and, in certain embodiments, to output information to the operator. The operator interface 700 includes one or more input devices configured to receive inputs from the operator. In various embodiments, the one or more input devices include one or more buttons (such as hard or soft keys), one or more switches, and/or a touch panel. In various embodiments, the operator interface 700 includes a display device configured to display information to the operator, such as information about the load, the status of the wrapping operation, or the parameters of the wrapping machine 10. In this example embodiment, the operator interface 700 is mounted to the mast 200, though it may be positioned in any suitable location in other embodiments. In this example embodiment, the operator interface 700 includes the speaker 800, which is configured to output sound The one or more sensors 900 include any suitable sensors, such as microswitches, optical sensors, ultrasonic sensors, magnetic position sensors, laser sensors, and the like, configured to detect certain parameters and to send appropriate signals to the controller 1000. The sensors 900 may include, for instance, a sensor configured to detect when a load is within the loading zone LZ, a sensor configured to detect when an object other than a load is within the wrapping zone WZ, sensors configured to detect rotation of certain of the rollers of the wrapping-material carriage 500, and a sensor configured to detect when the wrapping arm 420 contacts an object.

The controller 1000 includes a processing device (or devices) communicatively connected to a memory device (or devices). For instance, the controller may be a programmable logic controller. The processing device may include any suitable processing device such as, but not limited to, a general-purpose processor, a special-purpose processor, a digital-signal processor, one or more microprocessors, one or more microprocessors in association with a digital-signal processor core, one or more application-specific integrated circuits, one or more field-programmable gate array circuits, one or more integrated circuits, and/or a state machine. The memory device may include any suitable memory device such as, but not limited to, read-only memory, random-access memory, one or more digital registers, cache memory, one or more semiconductor memory devices, magnetic media such as integrated hard disks and/or removable memory, magneto-optical media, and/or optical media. The memory device stores instructions executable by the processing device to control operation of the wrapping machine 10.

The controller 1000 is communicatively and operably connected to the arm actuator 400*a* and the carriage actuator 500*a* and configured to receive signals from and to control those components to control rotation of the rotatable arm 400 and to control vertical movement of the wrapping-material carriage 500. The controller 1000 is communicatively and operably connected to the indicating device 600, the operator interface 700, and the speaker 800 and configured to received signals from and to control those components. The controller 1000 is communicatively connected to and configured to receive signals from the sensor(s) 900.

Figure 6A:
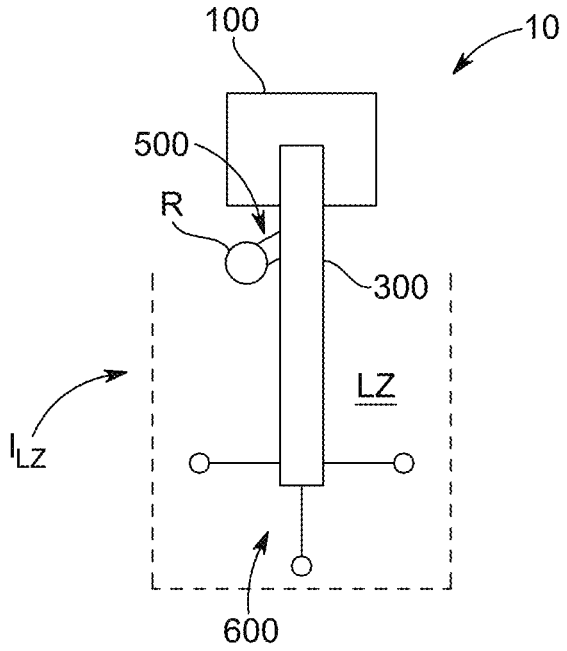
FIGS. 6A-6G are diagrammatic top plan views of the wrapping machine of FIG. 1 showing a load being positioned in the loading zone of the wrapping machine and then partially wrapped by the wrapping machine.

Operation of the wrapping machine 10 to carry out a wrapping process is now described in conjunction with FIGS. 6A-6G, which show certain components of the wrapping machine 10 in a simplified diagrammatic format for clarity. As shown in FIG. 6A, the rotatable arm 400 is initially in a home position in which the wrapping-arm support 410 is generally aligned with and below the rotatable-arm support 300 and the wrapping arm 420 and the carriage 500 is adjacent the mast 200. The carriage 500 supports a roll R of plastic stretch film F. While awaiting a load for wrapping, the controller 1000 controls the indicating device 600 to indicate the loading zone LZ of the wrapping machine 10 by projecting the loading-zone indicator $I_{LZ}$ using the light sources 610, 620, and 630, as explained above.

Figure 6B:
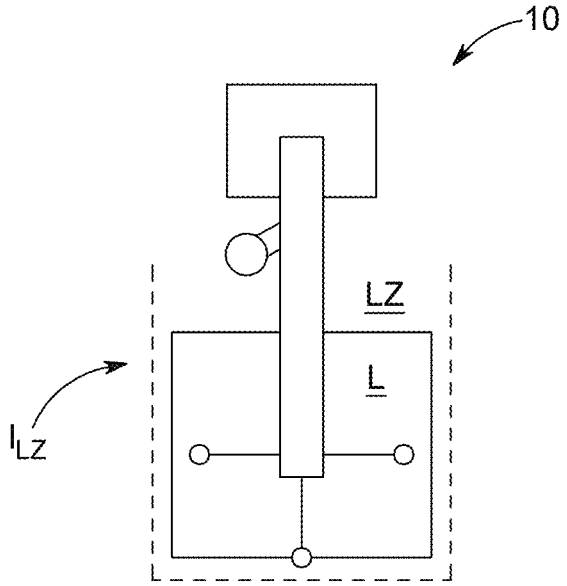

As shown in FIG. 6B, a load L is positioned within the loading zone LZ of the wrapping machine 10. Depending on the configuration of the wrapping machine 10 and the load L, this can be accomplished by moving the load L relative to the wrapping machine 10, by moving the wrapping machine 10 relative to the load L, or a combination of both. The loading-zone indicator $I_{LZ}$ takes the guesswork out of properly positioning the load because it shows operators exactly where they should position the load for proper wrapping.

Figure 6C:
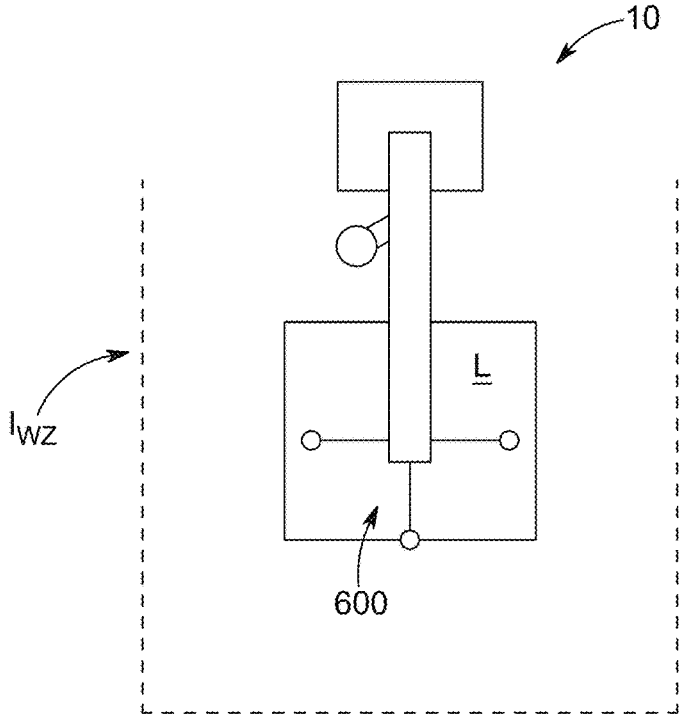
Figure 6D:
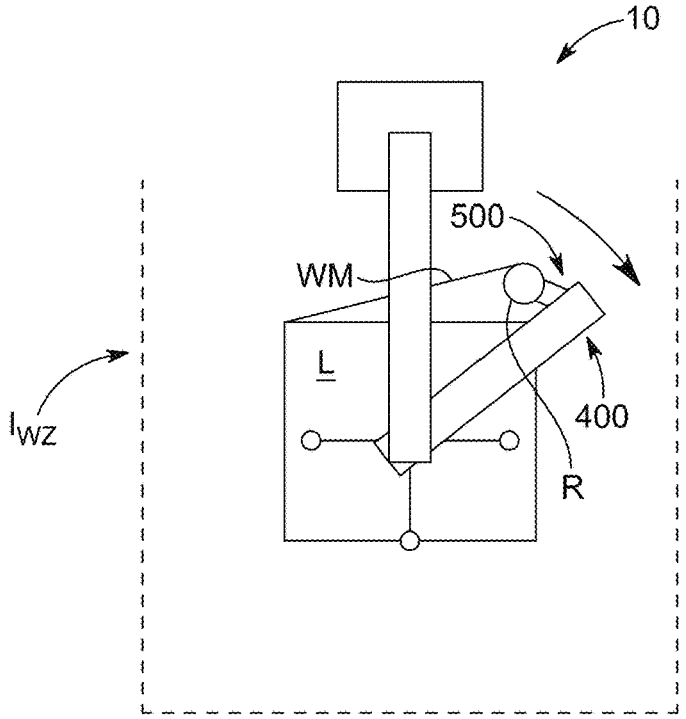
Figure 6E:
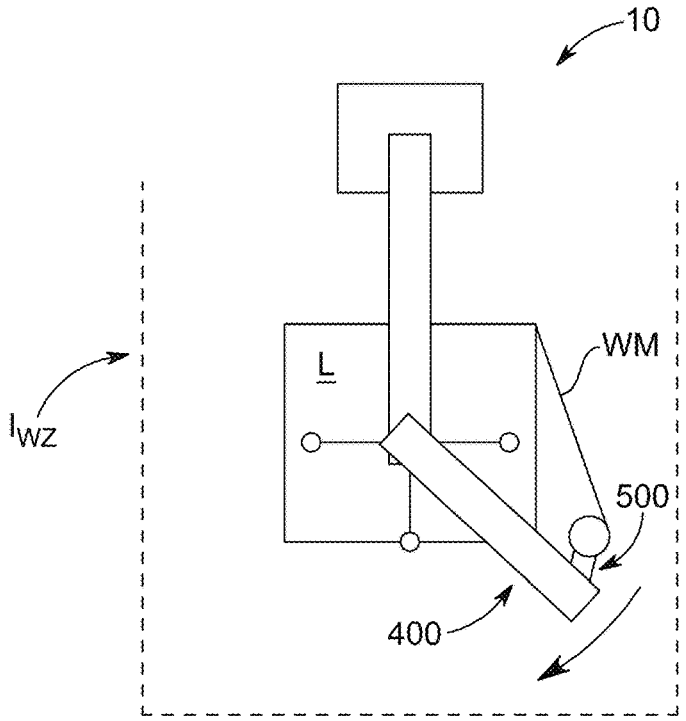
Figure 6F:
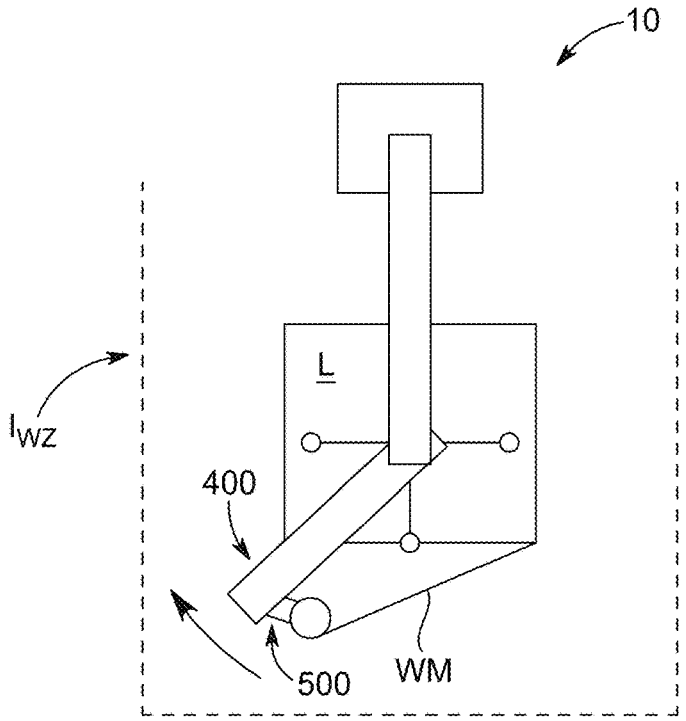
Figure 6G:
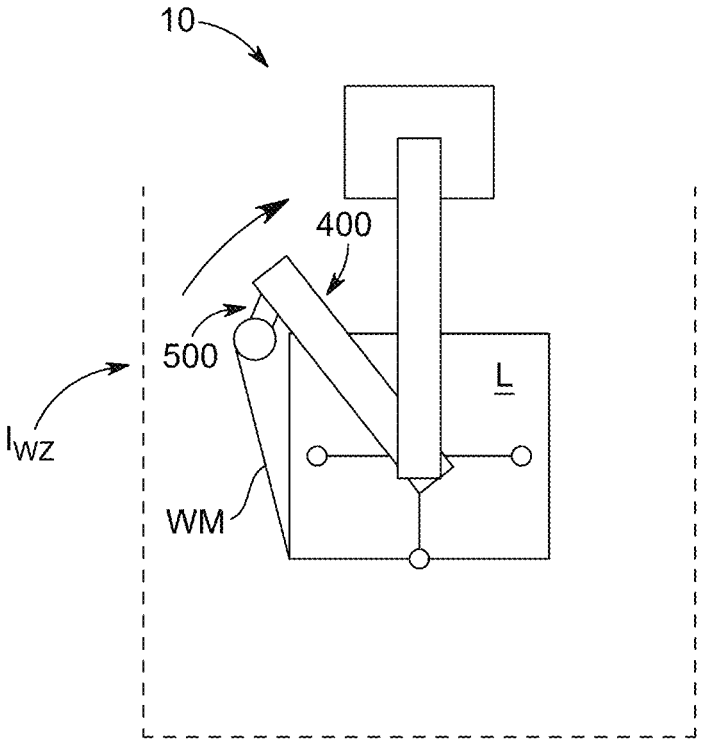

After the load L is positioned in the loading zone LZ, the operator provides an input to the operator interface 700 to initiate the wrapping operation. In response and as shown in FIG. 6C, the controller 1000 controls the indicating device 600 to: (1) stop indicating the loading zone LZ by controlling the light sources 610, 620, and 630 to stop projecting the loading-zone indicator $I_{LZ}$; and (2) indicate the wrapping zone WZ of the wrapping machine 10 by projecting the wrapping-zone indicator $I_{WZ}$ using the light sources 610, 620, and 630, as explained above. The controller 1000 then initiates the wrapping operation and controls the arm actuator 400*a* to begin rotating the rotatable arm 400 in the wrapping direction about the axis $A_{400}$. FIGS. 6D-6G show the rotatable arm 400 completing nearly a full rotation, during which film F drawn from the roll R is applied to the load L.

The controller 1000 continues to control the indicating device 600 to indicate the wrapping zone WZ via the wrapping-zone indicator $I_{WZ}$ as the rotatable arm 400 is rotating during the wrapping operation. Once the wrapping operation is complete and the rotatable arm 400 has returned to its home position, the controller 1000 controls the indicating device 600 to stop indicating the wrapping zone WZ by controlling the light sources 610, 620, and 630 to stop projecting the wrapping-zone indicator $I_{WZ}$. This indicates to the operator that the load L can be removed from the loading zone LZ.

The indicating device of the present disclosure solves the above-described problems by providing on-demand indication of the wrapping zone regardless of the location of the wrapping machine. This eliminates the need for upkeep of painted or taped indicators on the floor of a facility while enabling the wrapping machines to be moved and used anywhere as desired.

While the wrapping machine is a rotary-arm wrapping machine in the above-described example embodiment, the wrapping machine may be any suitable wrapping machine (such as a ring or turntable wrapping machine).

In certain embodiments, controller is configured to vary (via the indicating device) the loading-zone indicator based on whether a load is properly positioned in the loading zone (e.g., positioned within the loading zone without extending out of the loading zone and into the wrapping zone). The controller is configured to do so based on feedback from the sensor(s). In one such embodiment, the controller is configured to control the indicating device to flash the loading-zone indicator until the controller determines that a load is properly positioned within the loading zone, at which point the controller is configured to control the indicating device to statically project the loading-zone indicator to indicate the proper positioning of the load. In another embodiment, the controller is configured to control the indicating device to project the loading-zone indicator in one color (such as red) until the controller determines that a load is properly positioned within the loading zone, at which point the controller is configured to control the indicating device to project the loading-zone indicator in another color (such as green) to indicate the proper positioning of the load. In another embodiment, the controller is configured to control the indicating device to project the loading-zone indicator at a first brightness level (such as a high brightness level) until the controller determines that a load is properly positioned within the loading zone, at which point the controller is configured to control the indicating device to project the loading-zone indicator at a different second brightness level (such as a low brightness level) to indicate the proper positioning of the load. These embodiments provide an additional benefit in that they alert the operator when the load is properly positioned, taking the guesswork out of positioning the load.

The invention claimed is:

1. A wrapping machine comprising:

a wrapping-material carriage configured to support a roll of wrapping material;

an actuator operably connected to the wrapping-material carriage and configured to move the wrapping-material carriage along a path, wherein the path defines a wrapping zone; and an indicating device configured to project a visible loading-zone indicator including a loading-zone boundary at least partially surrounding a loading zone of the wrapping machine, wherein the loading zone is an area in which a load is positioned to be wrapped by the wrapping machine.

2. The wrapping machine of claim 1, further comprising a controller configured to control the indicating device to project the loading-zone indicator.

3. The wrapping machine of claim 2, wherein the controller is configured to control the indicating device to project the loading-zone indicator before controlling the actuator to begin moving the wrapping-material carriage along the path.

4. The wrapping machine of claim 1, wherein the indicating device is further configured to project a visible wrapping-zone indicator including a wrapping-zone boundary at least partially surrounding the wrapping zone.

5. The wrapping machine of claim 4, further comprising a controller configured to control the indicating device to project the wrapping-zone indicator while controlling the actuator to move the wrapping-material carriage along the path.

6. The wrapping machine of claim 4, wherein the loading zone is within the wrapping zone.

7. The wrapping machine of claim 6, wherein the wrapping-zone boundary is substantially circular and the loading-zone boundary is substantially rectangular.

8. The wrapping machine of claim 1, wherein the indicating device comprises one or more light sources.

9. A method of operating a wrapping machine, the method comprising:

projecting, onto a support surface, a visible loading-zone indicator including a loading-zone boundary at least partially surrounding a loading zone of the wrapping machine;

after a load has been positioned in the loading zone, moving a wrapping-material carriage along a path around the load, the path defining a wrapping zone; and while moving the wrapping-material carriage along the path, applying wrapping material from a roll of wrapping material on the wrapping-material carriage to the load.

10. The method of claim 9, further comprising projecting the loading-zone indicator onto the support surface before moving the wrapping-material carriage along the path.

11. The method of claim 9, further comprising projecting, onto the support surface, a visible wrapping-zone indicator including a wrapping-zone boundary at least partially surrounding the wrapping zone.

12. The method of claim 11, further comprising projecting the wrapping-zone indicator while moving the wrapping-material carriage along the path.

13. The method of claim 12, further comprising projecting the loading-zone indicator onto the support surface before moving the wrapping-material carriage along the path.

14. The method of claim 13, further comprising stopping the projection of the loading-zone indicator and starting the projection of the wrapping-zone indicator responsive to receipt of an operator input to begin a wrapping process.

15. The method of claim 11, wherein the loading zone is within the wrapping zone.

16. The method of claim 15, wherein the wrapping-zone boundary is substantially circular and the loading-zone boundary is substantially rectangular.

17. The method of claim 11, further comprising projecting the loading-zone and wrapping-zone indicators via one or more light sources.

* * * * *